United States Patent [19]

Schmidt

[11] 3,954,593

[45] May 4, 1976

[54] METHOD FOR ATTACHING ANODE TO ELECTROLYTIC CELL BOTTOM AND DEVICE THEREFORE

[75] Inventor: John E. Schmidt, Baton Rouge, La.

[73] Assignee: BASF Wyandotte Corporation, Wyandotte, Mich.

[22] Filed: Oct. 23, 1973

[21] Appl. No.: 408,468

Related U.S. Application Data

[63] Continuation of Ser. No. 175,221, Aug. 26, 1971, abandoned.

[52] U.S. Cl. ..... 204/252; 204/258; 204/266; 204/286

[51] Int. Cl.[2] ..... C25B 9/02; C25B 9/04

[58] Field of Search ..... 204/252,266, 258, 286

[56] References Cited

UNITED STATES PATENTS

| | | | |
|---|---|---|---|
| 1,898,352 | 2/1933 | Enzor | 204/258 |
| 3,583,898 | 6/1971 | Giacopelli | 204/266 X |
| 3,591,483 | 7/1971 | Loftfield et al. | 204/266 X |

FOREIGN PATENTS OR APPLICATIONS

| | | | |
|---|---|---|---|
| 1,125,493 | 8/1968 | United Kingdom | 204/286 |

*Primary Examiner*—John H. Mack
*Assistant Examiner*—A. C. Prescott
*Attorney, Agent, or Firm*—Bernhard R. Swick; John W. Linkhauer; Robert E. Dunn

[57] ABSTRACT

In a diaphragm-type electrolytic cell for the production of chlorine and caustic alkali from alkali metal chloride solutions and having a plate type of coated metallic anode there are provided means for attaching the plate and detaching the plate anode from the cell base means without movement or destruction of either the cell base or the non-conductive corrosion resistant liner above the bus bar.

3 Claims, 4 Drawing Figures

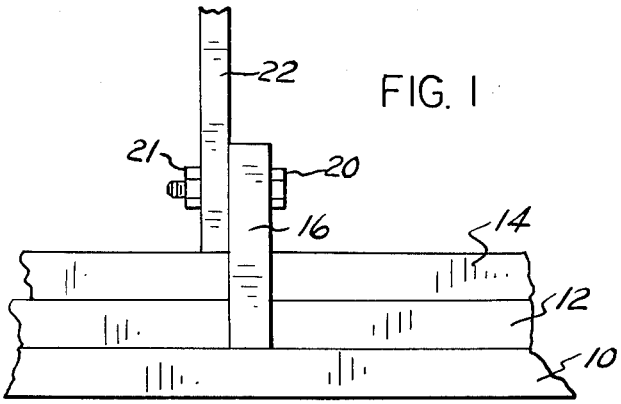
FIG. 1
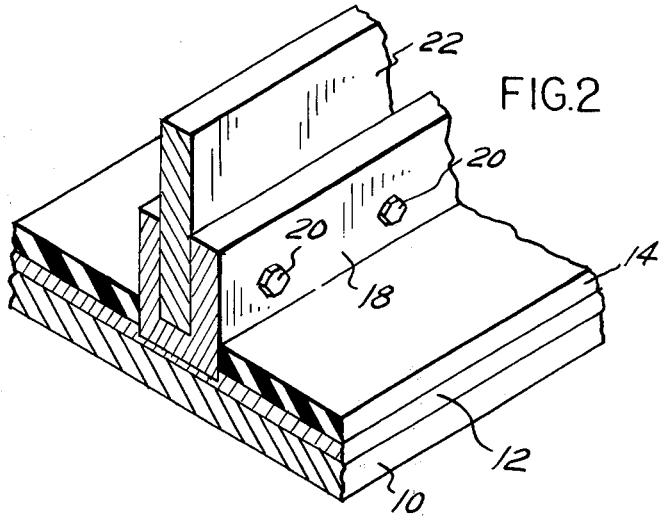
FIG.2
FIG.3
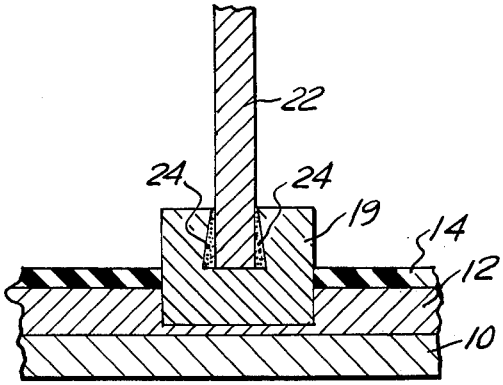
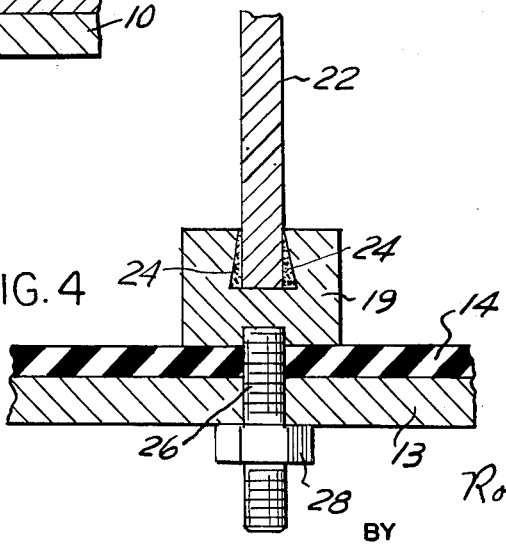
FIG. 4
INVENTOR
JOHN E. SCHMIDT
BY Robert M Phipps
ATTORNEY

METHOD FOR ATTACHING ANODE TO ELECTROLYTIC CELL BOTTOM AND DEVICE THEREFORE

This is a continuation of my earlier filed copending application Ser. No. 175,221, filed Aug. 26, 1971, and now abandoned.

BACKGROUND

1. Field of the Invention

This invention relates to electrolytic cells and particularly to electrolytic cells adapted for the production of chlorine and caustic, the cells being commonly known in the art as diaphragm-type cells. A new method of attaching and a device for the attachment of the metal plate anodes are provided.

2. Description of the Prior Art

Typically the electrolytic cell of the diaphragm type used for the production of caustic and chlorine is a cast concrete shell to which have been added connecting bus bars and graphite anodes. Electrical connections are made between the graphite anodes and the bus bars by pouring an easily melted conductive metal such as lead on top of the bus bars and around the base of the anodes. Then so as to save the solidified conductive metal from attack in the cell, the area is sealed off with a very heavy coat of mastic or other non-conductive lining material. A more extensive treatment of the construction, maintenance and operations of these cells is found in the textbook, "Chlorine", ACS Monograph No. 154, James S. Sconce, Editor, Reinhold Publishing Company, New York, N.Y. 1962, page 92 et seq., which is incorporated herein by reference thereto. Most recently various types of coated metallic anodes generally referred to as dimensionally stable anodes have been developed for use in the diaphragm type cell. Since the rebuilding of the cell bottom is expensive, both in terms of actual cost and loss of production, it is desirable to avoid disturbing the cell bottom regardless of whether the graphite anode or the newer metal plate anode is employed.

SUMMARY OF THE INVENTION

It is an object of this invention to provide an apparatus or device for permitting the installation and removal of metal plate anodes without disrupting the bus bar means and the non-conductive lining material over the bus bar means. It is also another object of this invention to provide a method for the renewal of the metal plate anodes without destructive interruption of the cell bottom. These and other objects will become more apparent to those skilled in the art upon reading of the specification and the drawings to which it refers.

In accordance with this invention, there is provided in a diaphragm-type electrolytic cell for the production of chlorine and caustic alkali from alkali metal chloride solutions the improvement comprising a liner of non-conductive material extending substantially over the bottom of the cell, a conductive anode plate support member projecting upwardly into the cell through the liner, bus bar means electrically connected to said support member and means for replaceably securing an anode plate to said support member in an electrically conductive relationship therewith. In using the foregoing improvement, to the conventional bus bar means and in an electrically conductive relationship a conductive anode plate support is attached, and the bus bar means is then covered with a layer of electrically non-conductive material while allowing said anode plate support to project upwardly through the covering material and then attaching to the anode plate support in an electrically conductive relationship an anode plate.

DESCRIPTION OF THE DRAWING

FIG. 1 is an end view of a very simple embodiment of the apparatus of this invention.

FIG. 2 is a three-quarter sectional view of another embodiment of the invention.

FIG. 3 is an end view of still another embodiment of the invention while FIG. 4 is a modification of the embodiment of FIG. 3.

DESCRIPTION OF THE PREFERRED EMBODIMENT

In this invention as shown in FIG. 1 there is provided bus bar means 12 resting upon the conventional concrete cell base 10. Permanently mounted in and optionally going through the bus bar means 12 is the conductive anode support plate 16 which protrudes through the liner of non-conductive material 14 that covers the bus bar means 12. The anode plate 22 is attached to the anode support 16 and maintained in electrical connection by bolt 20 going through the anode support 16 and anode plate 22 and having a nut 21 engaged on the other end. The exact configuration of bolt 20 and nut 21 for achieving optimum electrical connection is well within the skill of the art and needs no further elaboration at this point.

In another variation of this invention, shown in FIG. 2, the conductive anode support 18 is in the shape of a U-channel and embedded in the bus bar means 12 rather than going all the way through the bus bar means 12. The anode plate 22 is slipped within the upwardly projecting arms of the U-channel anode support 18 and bolted 20 into place to form good electrical connection. While bolts 20 offer a very convenient way of achieving the desired electrical and mechanical contact, it will be obvious that other fastening means such as screws and keyways can be employed to achieve the same result.

A second variation of the invention is shown in FIG. 3 wherein a keyway 19 is employed in place of U-shaped channel 18 conductive anode support. The keyway conductive anode support 19 is embedded in the bus bar means 12. The anode plate 22 is driven in the keyway anode support 19 which also optionally contains resin conductance enhancer 24 for electrical efficiency, e.g. a silver epoxy resin composition.

Alternatively keyway conductive anode support 19 can be used where the cell base 10 and bus bar means 12 are combined into a unified bus bar and cell base 13 as shown in FIG. 4. For such use one or more studs 26 are attached to keyway anode support 19. The number of studs 26 are determined according to well known electrical principles which need no further elucidation at this time. Stud 26 can be attached by providing corresponding engaging threads in the base of key anode support 19 and stud 26 as shown in FIG. 4 or simply welding stud 26 to keyway anode support 19. The stud 26 can be of copper with platinized threads or of a restricted valve metal (see below) as desired. Stud 26 is inserted through axially aligned holes or apertures of liner 14 and combined bus bar and cell 13 and fastened thereto with the use of stud nut 28.

The non-conductive material utilized in the liner 14 can be any of the well known lining materials of the prior art including but not limited to asphaltic mastics, rubber, chlorinated plastics, and polymers and copolymers of trifluorochloroethylene and tetrachloroethylene and tetrafluoroethylene sold under tradenames such as Teflon and Kel-F.

The conductive anode support whether of the plate type 16, the U-channel shape type 18 or keyway type 19 as well as the anode plate 22 are suitably made from a "restrictive valve" metal or an alloy thereof. By restrictive valve metals are meant the metals titanium, tantalum and niobium. Preferably titanium is employed and it is normally a commercially pure grade such as electrolytic grade. Alloys of titanium may be employed as long as they meet the criterion of passivity, i.e., metal alloys which become passivated when polarized anodically and remain passive well beyond the anodic potential needed to convert a chlorine ion to chlorine. The phenomenon passivity in this connection is discussed in an article by Greene, appearing in the April 1962 issue of Corrosion, volume 18, published by the National Association of Corrosion Engineers, pages 136-t to 142-t wherein reference may be made to FIG. 1 of the article, which describes typical active-passive transition of a metal towards a corrosive medium. Titanium-base alloys of aluminum, vanadium, palladium, chromium or tin can be employed in which the latter metals are present as less than 10% of the alloy.

The number of bolts and nuts, or screws or other fastening means employed in fastening the anode plate 22 to the conductive anode support 18 or 16 is not critical in the operation of the invention provided the requirements of adequate mechanical strength and adequate electrical conductivity are met.

From the description of the apparatus involved it will become readily apparent that the invention may be carried out by attaching to or through the bus bar means 12 or 13 the anode support plate 19, 18 or 16 (this includes covering the actual copper bus bar with soft metal such as lead as appropriate) and then covering the bus bar means 12 with a non-conductive lining material 14 so that the cell bottom is completely covered with the non-conductive lining material 14 except for where the anode support 16, 18 or 19 protrudes through the non-conductive liner 14. Thereafter the anode plate 22 is mechanically connected to the anode support plate 16 or 18 by the use of bolts 20 and nuts 21 or other mechanical fastening devices. With anode support plate 19, anode plate 22 is driven in. The cell is then readied for operation in the usual manner. It is now readily apparent that the anode plate 22 can be simply and readily replaced by removing the diaphragm and draining the cell of the electrolyte and alkali metal chloride solutions, mechanically unfastening and removing anode plate 22 from the anode support 16 or 18 followed by insertion and fastening of a new anode plate 22 without having to disturb the non-conductive liner 14 or bus bar means 12.

Many other modifications and ramifications will naturally suggest themselves to those skilled in the art based on this disclosure. These ramifications and modifications are intended to be comprehended as within the scope of this invention.

Having thus described the invention, what it is desired to claim and secure by Letters Patent is:

1. In a diaphragm-type electrolytic cell for the production of chlorine and caustic alkali from alkali-metal chloride solutions, the improvement comprising:

1. a liner of electrically non-conductive material extending substantially over the bottom of said cell;
2. a single-piece conductive anode-plate-support member having a keyway-channel-shaped anode-receiving means projecting upwardly into the cell through said liner and above said liner interiorly of said cell bottom, said anode-receiving means being above said liner, said anode-plate-support member having non-leaded-in sealing means for maintaining an anode in electrically conductive relationship with said anode-plate-support means; and
3. bus-bar means electrically connected to said anode-plate-support member, said bus-bar means, said anode-plate-support member and said liner having a permanently fixed relationship which is not changed or disturbed while removing an anode from said cell.

2. In a diaphragm-type electrolytic cell for the production of chlorine and caustic alkali from alkali-metal chloride solutions, the improvement comprising:

1. a liner of electrically non-conductive material extending substantially over the bottom of said cell;
2. a combined bus-bar- and cell-bottom-support means, said combined support means and said liner having a permanently fixed relationship which is not changed or disturbed while removing an anode from said cell;
3. a single-piece conductive anode-plate-support member having a keyway-channel anode-plate-receiving member with a plurality of studs attached to the bottom of said support member which pass through said liner and said combined support means and are in an electrically conductive relationship with said combined support member, said anode-plate-support member having non-leaded-in sealing means for maintaining an anode in electrically conductive relationship with said anode-plate-support member, said anode-plate-support member being on top of said liner.

3. A method of attaching an anode plate to the bottom of a diaphragm-type electrolytic cell for the production of chlorine and alkali from alkali-metal chloride solution, said method comprising:

1. attaching to bus-bar means in an electrically conductive relationship a single-piece conductive anode-plate-support member having a keyway-shaped anode-receiving means and non-leaded-in sealing means;
2. covering the bottom of the cell including said bus-bar means with a layer of electrically non-conductive material while allowing said anode-plate-support member to project upwardly through said material and into the interior of said cell, said keyway-shaped anode-receiving means being above said material covering said bottom; said bus-bar means, said anode-plate-support member and said liner having a permanently fixed relationship which is not changed or disturbed while removing an anode from said cell; and
3. removably attaching to said anode-plate-support member in said keyway with non-leaded-in sealing means an anode in electrically conductive relationship with said anode-plate-support member.

* * * * *